US006010432A

United States Patent [19]

Vawter

[11] Patent Number: 6,010,432

[45] Date of Patent: Jan. 4, 2000

[54] COMBINATION EXERCISER AND MASSAGER

[76] Inventor: James R. Vawter, 460 Prairie Ridge Rd., Highlands Ranch, Colo. 80126

[21] Appl. No.: 09/121,204

[22] Filed: Jul. 22, 1998

[51] Int. Cl.[7] ..... A63B 22/02

[52] U.S. Cl. ..... 482/54; 601/84

[58] Field of Search ..... 482/54; 601/121, 601/84–103, 112, 114–117

[56] References Cited

U.S. PATENT DOCUMENTS

| | | | |
|---|---|---|---|
| 3,205,888 | 9/1965 | Stroop | 482/54 |
| 4,014,325 | 3/1977 | Clarke | 601/121 |
| 5,662,557 | 9/1997 | Watterson et al. | 482/54 |

*Primary Examiner*—Glenn E. Richman
*Attorney, Agent, or Firm*—Joseph C. Herring

[57] ABSTRACT

The treadmill exercisers include uprights 16, 16*a*, a treadmill 15 and treadmill frame 17, 17*a* and a two part treadmill 15 made up of two rows of rollers 33 separated by roller supports 34 which form an exerciser section 26 and massager section 27.

The rollers used in the treadmill preferably have a surface made of flat topped pyramids 46 formed by one or more spiral grooves 45 and substantially parallel longitudinal grooves 46. The preferred alternating rollers are preferably positioned so that the pyramids 46 are in a herringbone pattern.

11 Claims, 11 Drawing Sheets

COMBINATION EXERCISER AND MASSAGER

BACKGROUND OF THE INVENTION

A wide variety of treadmill-type exercisers are taught in the literature and marketed commercially. The same is true of devices which are intended to mimic cross-country skiing. Typical patented skiing-type exercise devices are:

U.S. Pat. No. 2,117,957 issued to H. F. Heller. The device of this patent has a base on which rests a frame for a treadmill, and an upright which is gripped by the exerciser, the treadmill has projections which fit into slots in the upright. The exerciser selects one of several slots to position the treadmill at a desired angle. U.S. Pat. No. 4,759,540 issued to Chi-Tsung Yu, et. al. This patent teaches a scissors jack for elevating a treadmill bed to a desired level.

Other patents combine a treadmill type exerciser with a foot massager. Typical patents teaching this approach are: U.S. Pat. No. 931,394 to Alfred Day which teaches a "treadmill" made up of a frame enclosing rollers which make up the "treads" and a vertical support. The frame can be set to a preferred angle and can be raised so that it is perpendicular to the floor on which the vertical support rests. U.S. Pat. No. 4,892,090 issued to Ernst Kaeser; U.S. Pat. No. 3,650,529 to V. A. Salm et al; U.S. Pat. No. 4,113,246 issued to D. J. Gibbs; U.S. Pat. No. 5,474,521 to Hsi-Hsim Yang and U.K. 2,043,464 to D. J. Gibbs all teach variations on the central theme.

Still others provide foot massaging devices for use by individuals in physical therapy or otherwise. U.S. Patents teaching massaging devices utilizing rollers include: U.S. Pat. No. D101,862 to Joseph Fehn teaches a frame holding two sets of rollers. The roller at the lower end has parallel grooves cut into a solid bar of uniform thickness. Each of the upper rollers have a different surface "envelope". U.S. Pat. No. 2,512,904 to A. J. Strelecky teaches a frame holding rollers which have no grooves and are of uniform diameter. U.S. Pat. No. 2,593,982 to C. D. Cash teaches a unit which provides frictional and kneading actions. The rollers alternate between flat ridges and flat valleys of equal width. In other words, the roller longitudinal surface is in the form of a square wave.

U.S. Pat. No. 3,205,888 to J. H. Stroop teaches a unit having rollers with a roller surface in the form of a longitudinal sinusoidal form.

U.S. Pat. No. 4,167,940 to Robert Ruf teaches a unit with an irregular surface of hills and valleys.

U.S. Pat. No. 5,674,185 to Chien-Chung Chang teaches a frame enclosing rollers which can be set at an angle for a foot massage.

This invention is an exerciser/massager unit which provides a combination of an exerciser and a removable massager. A person wanting to use the exerciser can use the combination and the person undergoing physical therapy can obtain "shiatsu" type massage by using only the massager when unable to exercise on the exerciser. Later, when the patient is stronger, the unit provides an opportunity to get a foot massage while exercising.

SUMMARY OF THE INVENTION

The exerciser/massager units of this invention combine an upright frame and a treadmill, a part of which can be removed and used as a foot massager. The units can be folded into a smaller space for storage. Preferably, the upright frame also has an arm rest and a display. Preferably it also has safety guards to help the user and prevent falling.

The treadmill has no endless belt and the user receives the full impact of a shiatsu-type massage by keeping the feet on the rollers and pushing to the rear while walking on the treadmill rollers or when sitting and running his or her feet over the massager rollers.

The rollers used in the treadmill preferably have a spiral groove(s) cut around the roller with parallel longitudinal grooves which form flat-topped, diamond shaped projections on which the exerciser walks or, when the massager is removed, uses to obtain a massage.

DETAILED DESCRIPTION OF THE FIGURES

Figure 1:
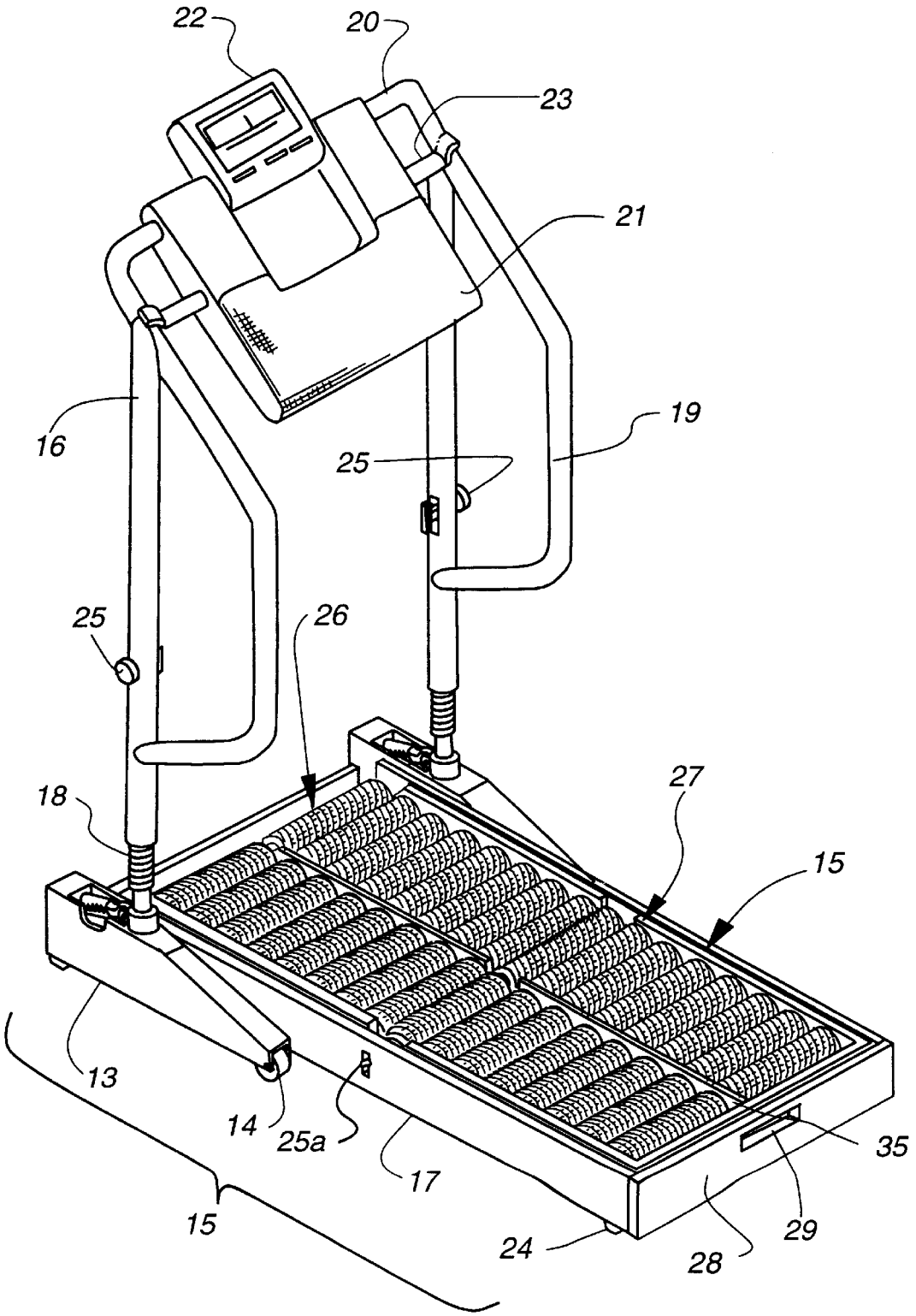
FIG. 1 depicts one model of the exerciser/massager in position for use.

The numbers identifying each element remain the same from Figure to Figure. Modified elements also have an alphabetic designator.

FIGS. 1–5 depict aspects of an exerciser/massager unit with a base 13 having base rollers 14 and treadmill 15 and which is connected to uprights 16 and treadmill frame 17. The uprights 16 are mounted on a screw jack 18. The uprights 16 each have a safety guard 19 mounted adjacent the treadmill which form, at the top, a support bar 20 for an arm rest 21 and a computer-based display 22. Various sensors (not shown) can be attached or plugged into the display 22. Arm rest 21 rotates counterclockwise from the position shown where padded support arms 23 position the arm rest 21 between the safety guards 19 as shown. Treadmill frame 17 is supported, when on the floor, by feet 24. Where positioned vertically, frame 17 is held in place by dagger lock 25 which fits into slot 25*a*.

Figure 12:
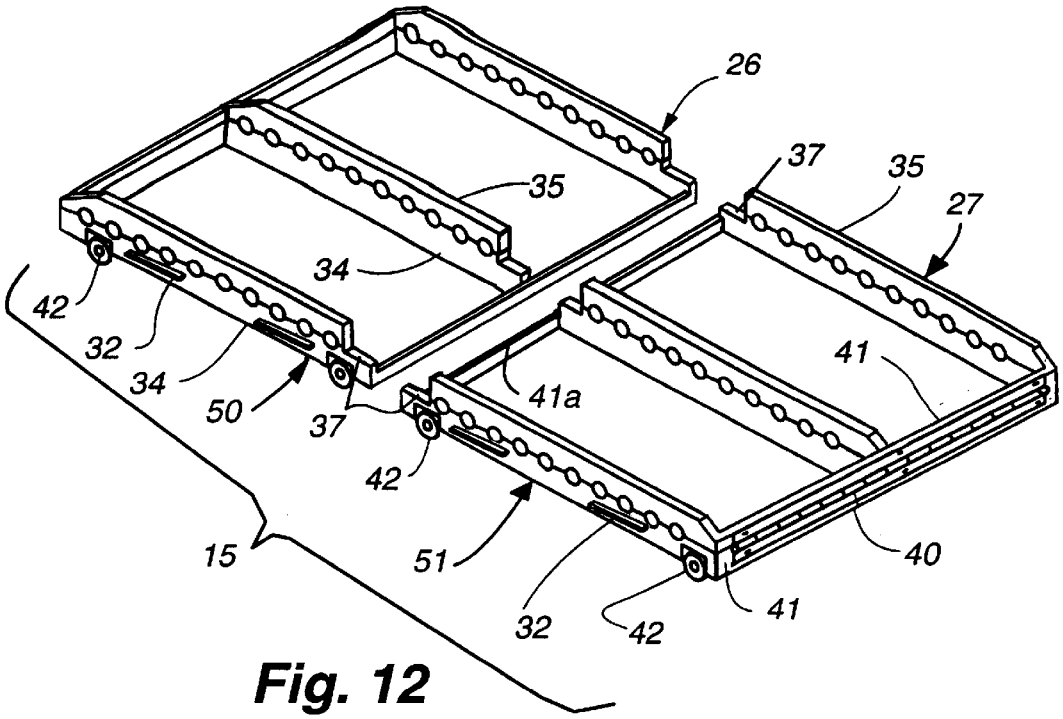
FIGS. 12 and 13 depict exerciser section and massager section frames.
Figure 13:
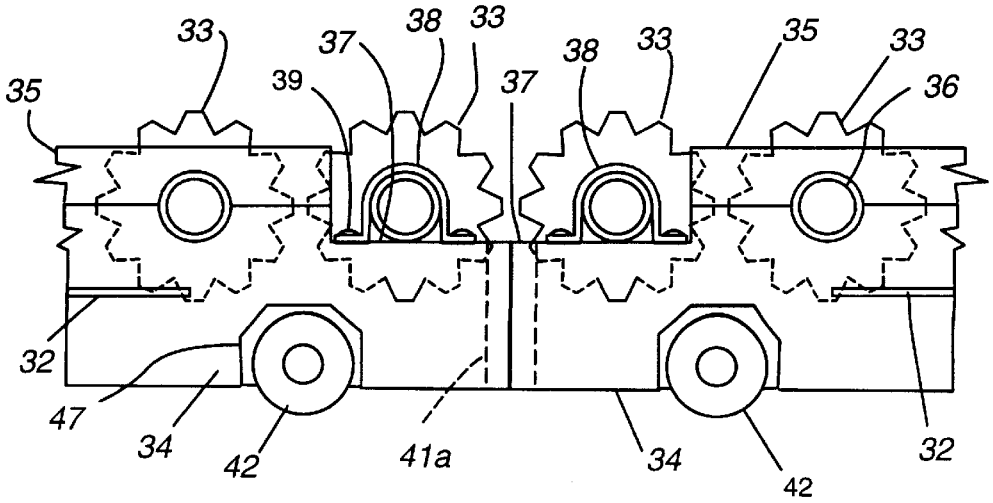

Treadmill frame 17 contains a treadmill 15 which is made up of two sections, an exerciser section 26 and a massager section 27 (see also FIGS. 12 and 13). The exerciser section 26 will normally be left in place within frame 17 but can be removed for repair. The massager section 27 can be removed easily. To move the exerciser/massager, the folded unit is tilted to the right and pushed, via base rollers 14, to a desired location for storage.

Figure 2:
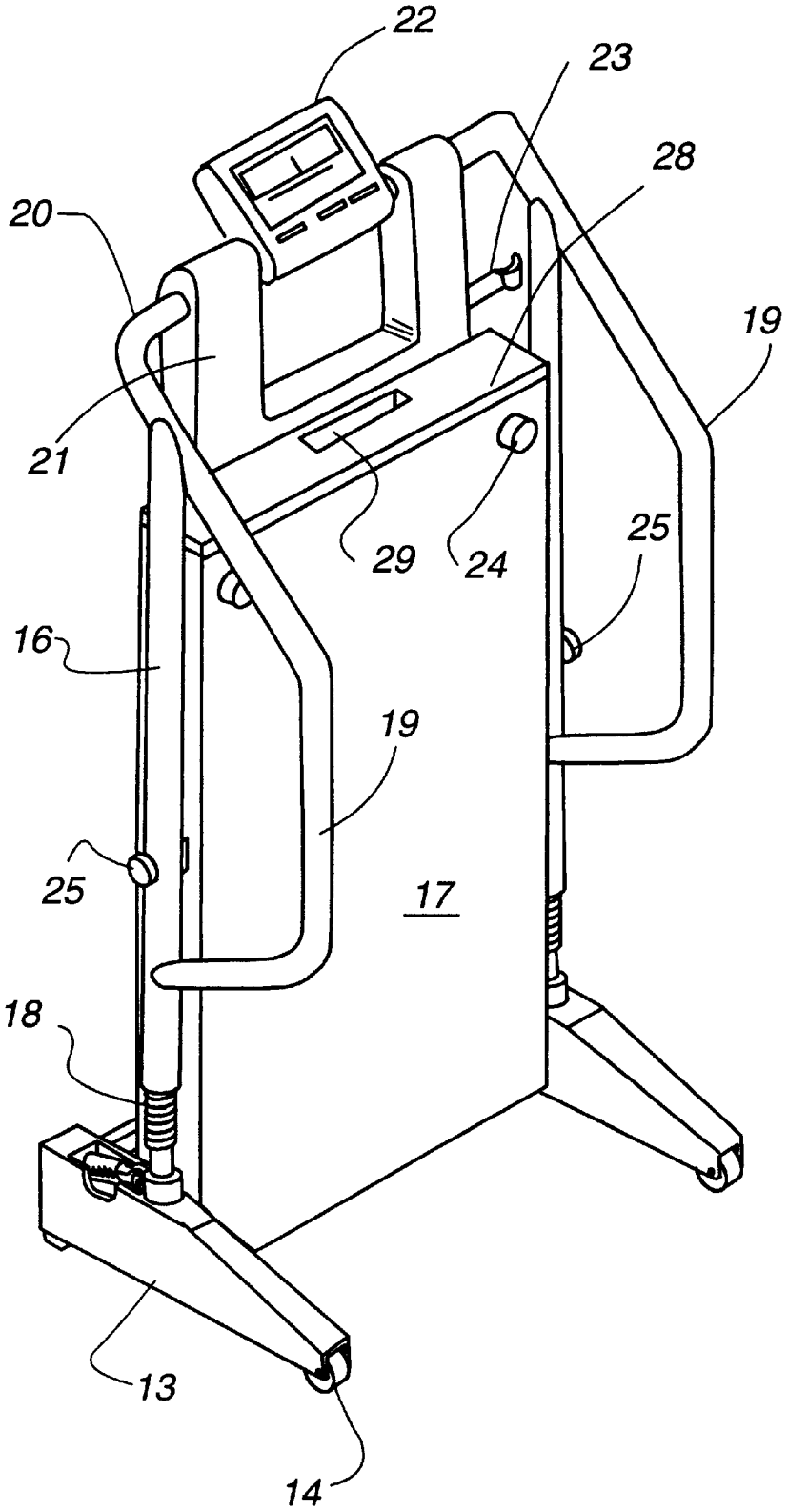
FIG. 2 depicts an exerciser/massager unit of FIG. 1 folded into a vertical position for storage.

In FIG. 2, the treadmill 15, within frame 17, and the armrest 21 have been rotated counterclockwise into the vertical position.

Figure 3:
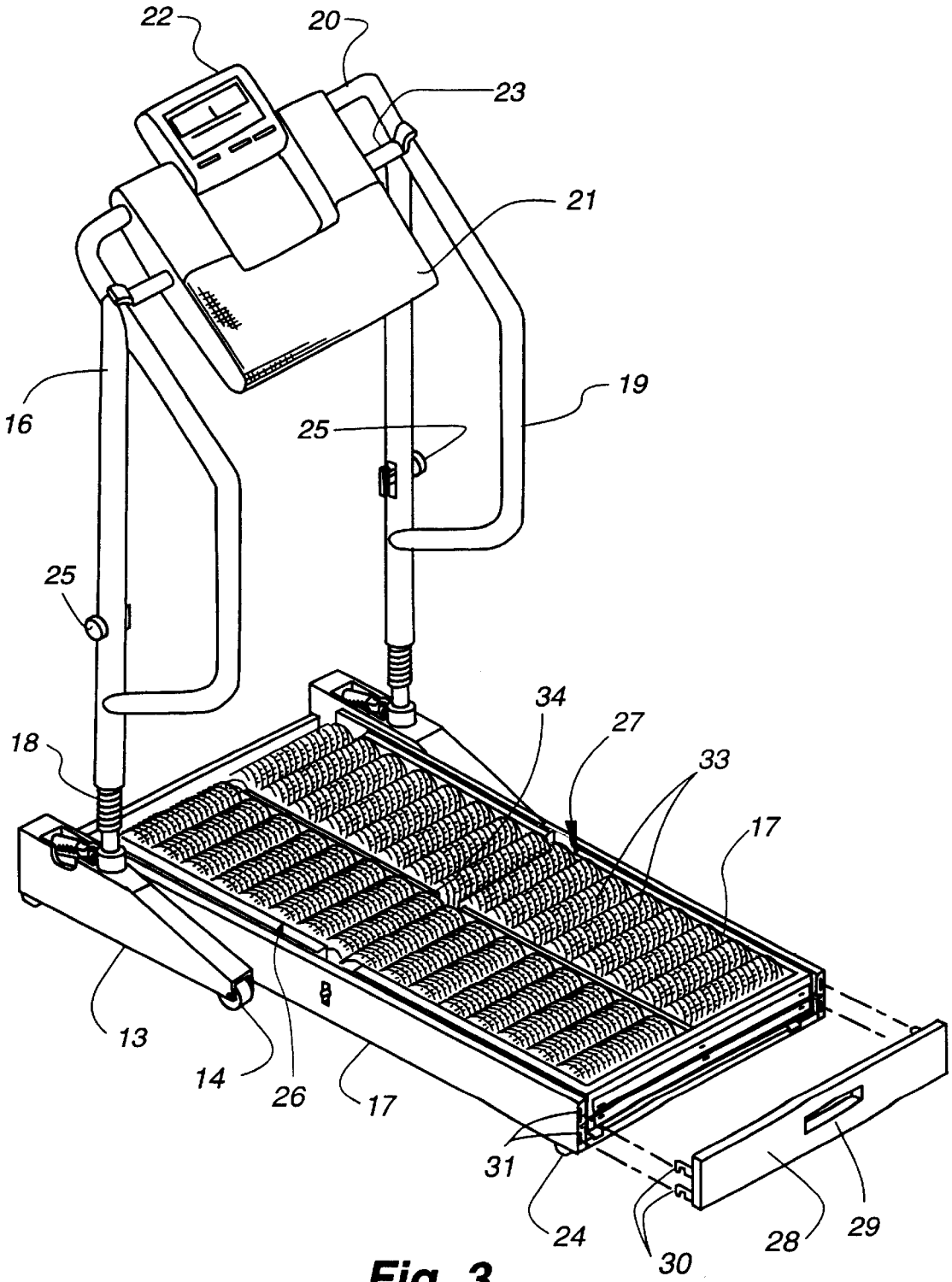
FIG. 3 shows the exerciser/massager unit of FIG. 1 with the end-board removed.

FIG. 3 shows a mechanism for removing the fixed section 26 and massager section 27 from the treadmill frame 17. The end board 28 of treadmill frame 17 is lifted and pulled by gripping end board 28 at slot 29. The end board 28 is held in the closed position as shown in FIGS. 1 and 2 in this model by conventional bed frame end board lock projections 30 which lock into bed frame slots 31. Flanges 32 lock the treadmill parts in place within the grooves (not shown) when in the vertical position.

Figure 4:
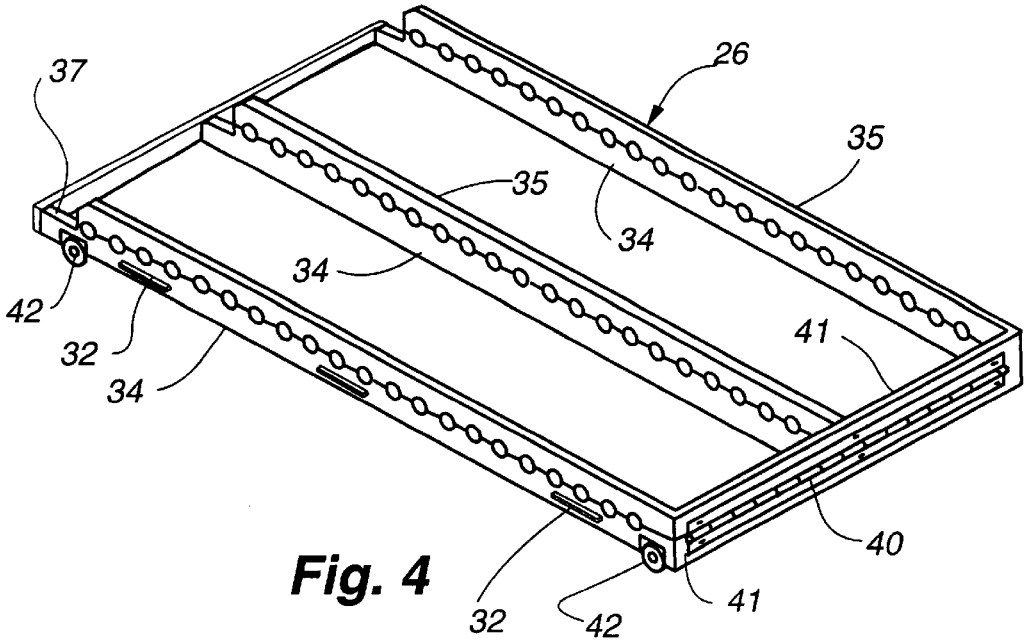
FIGS. 4 and 5 depict an exerciser section in the open and closed positions.
Figure 5:
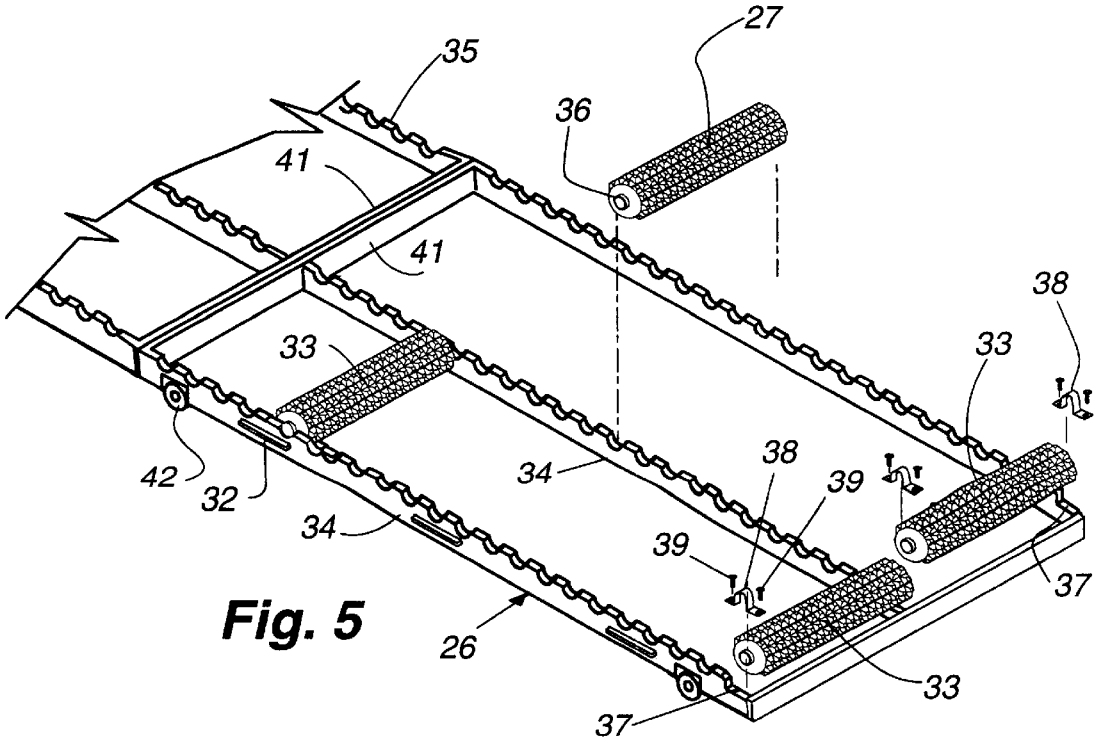

FIGS. 4 and 5 detail a fixed section 26 and rollers 33. Both are within frames which have roller supports 34 and upper locking frame 35 which fold over to enclose the roller axle assemblies 36 and position two rows of rollers 33 in parallel on the roller supports 34. At the adjacent ends of the exerciser section 26 and massager section 27, the rollers 33 are positioned on cut-outs 37 by metal fixtures 38 which are held in place by screws 39 (See FIGS. 5 and 11). Hinges 40 on cross supports 41 facilitate the insertion and removal of the rollers 27. Wheel assemblies 42 facilitate the removal of the massager section 27 and the exerciser section 26.

Figure 6:
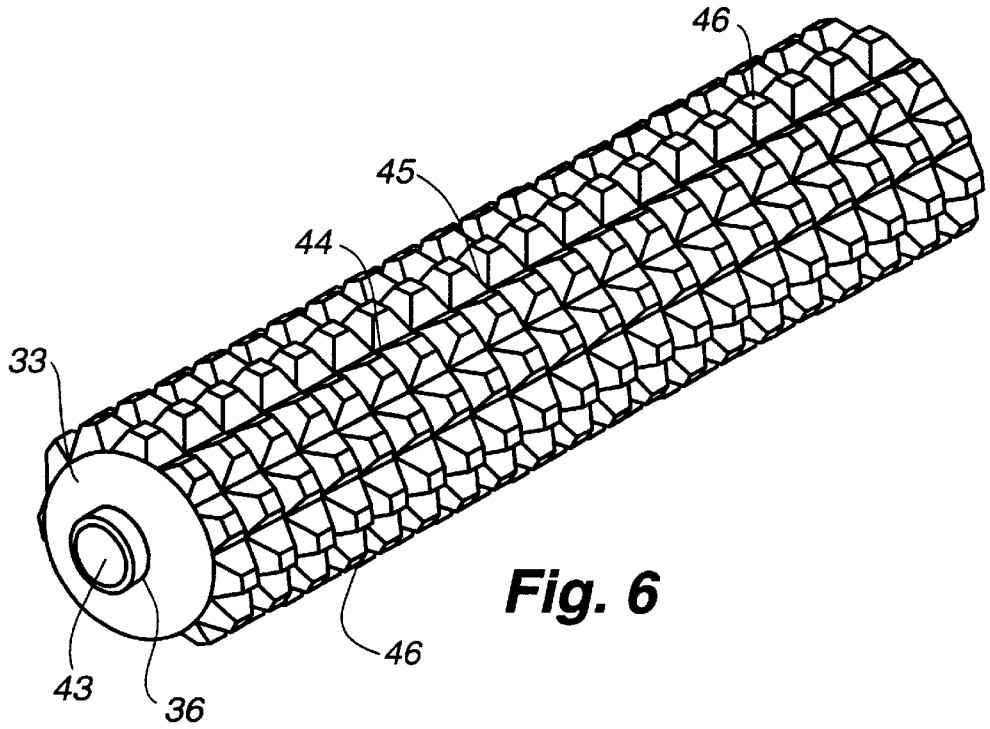
FIGS. 6 and 7 provide details about the preferred roller configuration.
Figure 7:
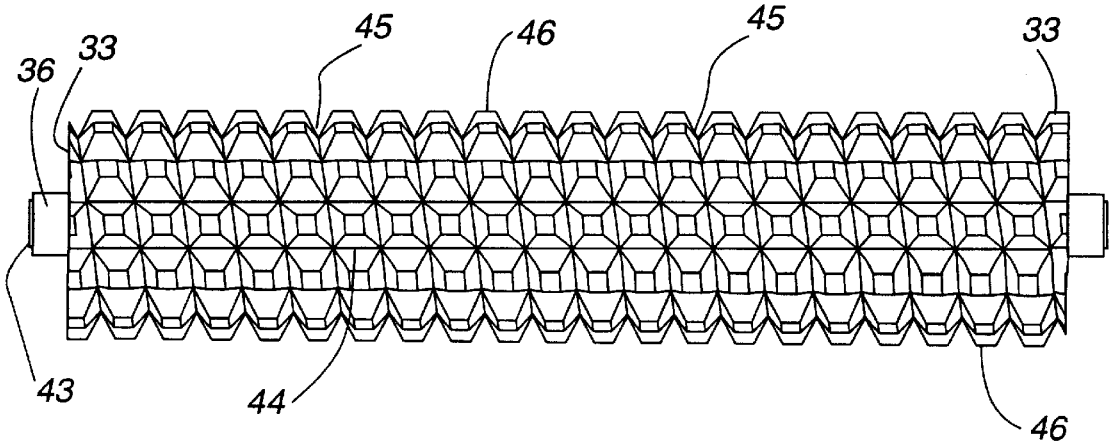

FIGS. 6 and 7 show details of the preferred rollers 27. In FIG. 6, roller 33 has a bearing assembly 36 around axle 43. Grooves 44 run longitudinally across the rollers 33 and groove(s) 45 spiral around the roller 33 and create a series of flat-top pyramids 46. Smaller longitudinal grooves (not shown) can be cut into the flat-topped pyramids 46.

Figure 8:
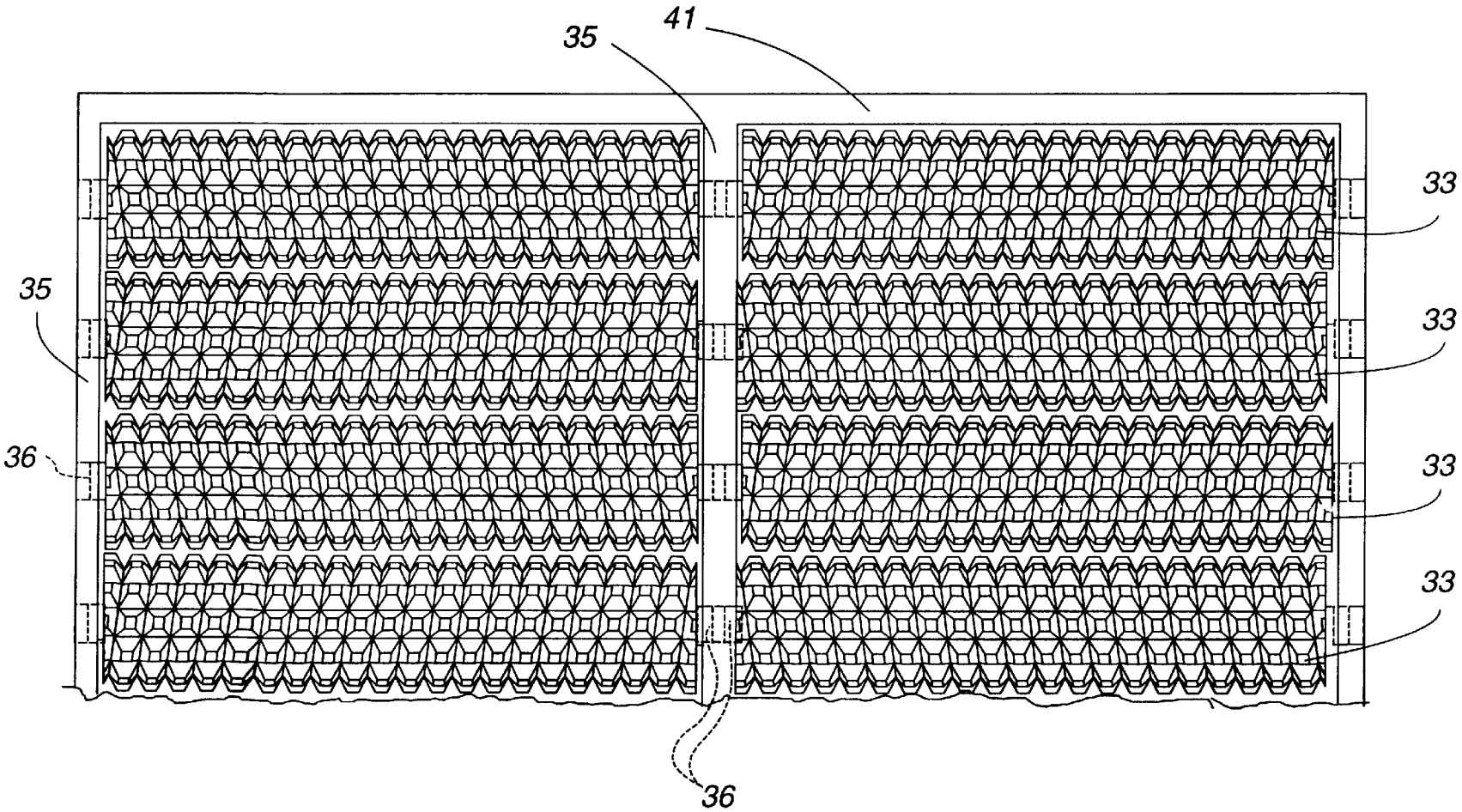
FIG. 8 provides a partial view of an exerciser section with the rollers in a preferred herringbone pattern.

FIG. 8 shows the rollers 33 in a preferred herringbone pattern.

Figure 9:
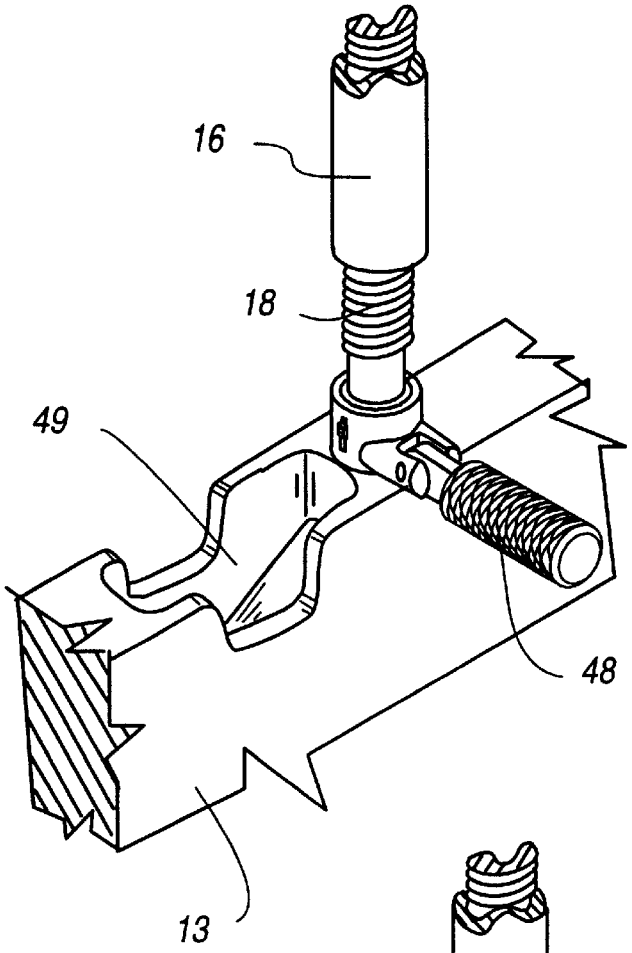
FIGS. 9 and 10 provide details of a screw jack for raising and locking the arm rests at a comfortable or desired height.
Figure 10:
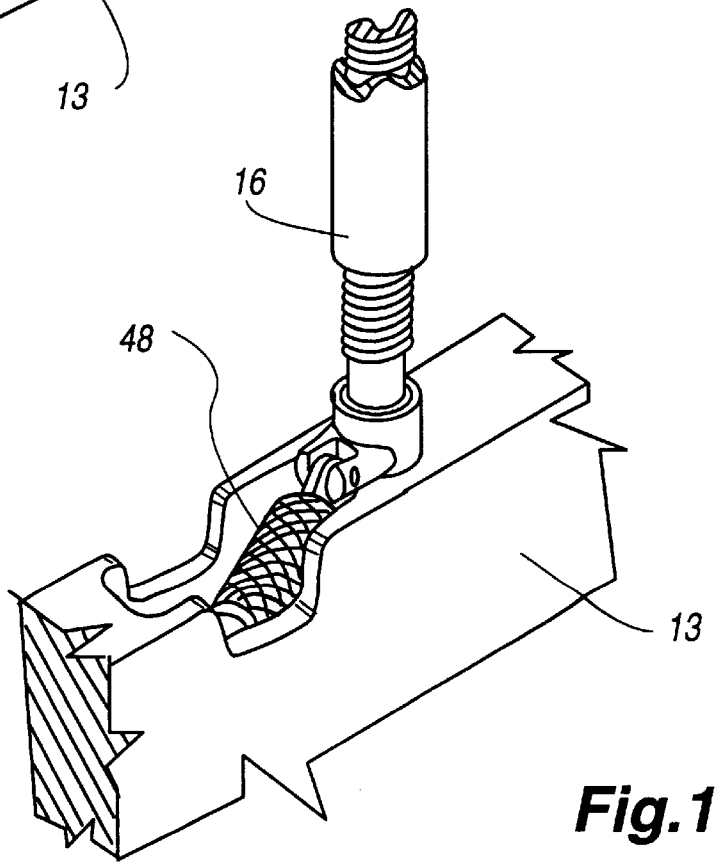

FIGS. 9 and 10 provide details of the screw jack 18 operating handle 48. To operate the jack 18, the knurled handle 48 is lifted out of recess 49, straightened horizontally as shown in FIG. 9, and rotated horizontally to lift or lower the upright 16. To lock the upright 16 at a desired height, the handles 48 are folded into recesses 49 as shown in FIG. 10.

Figure 11:
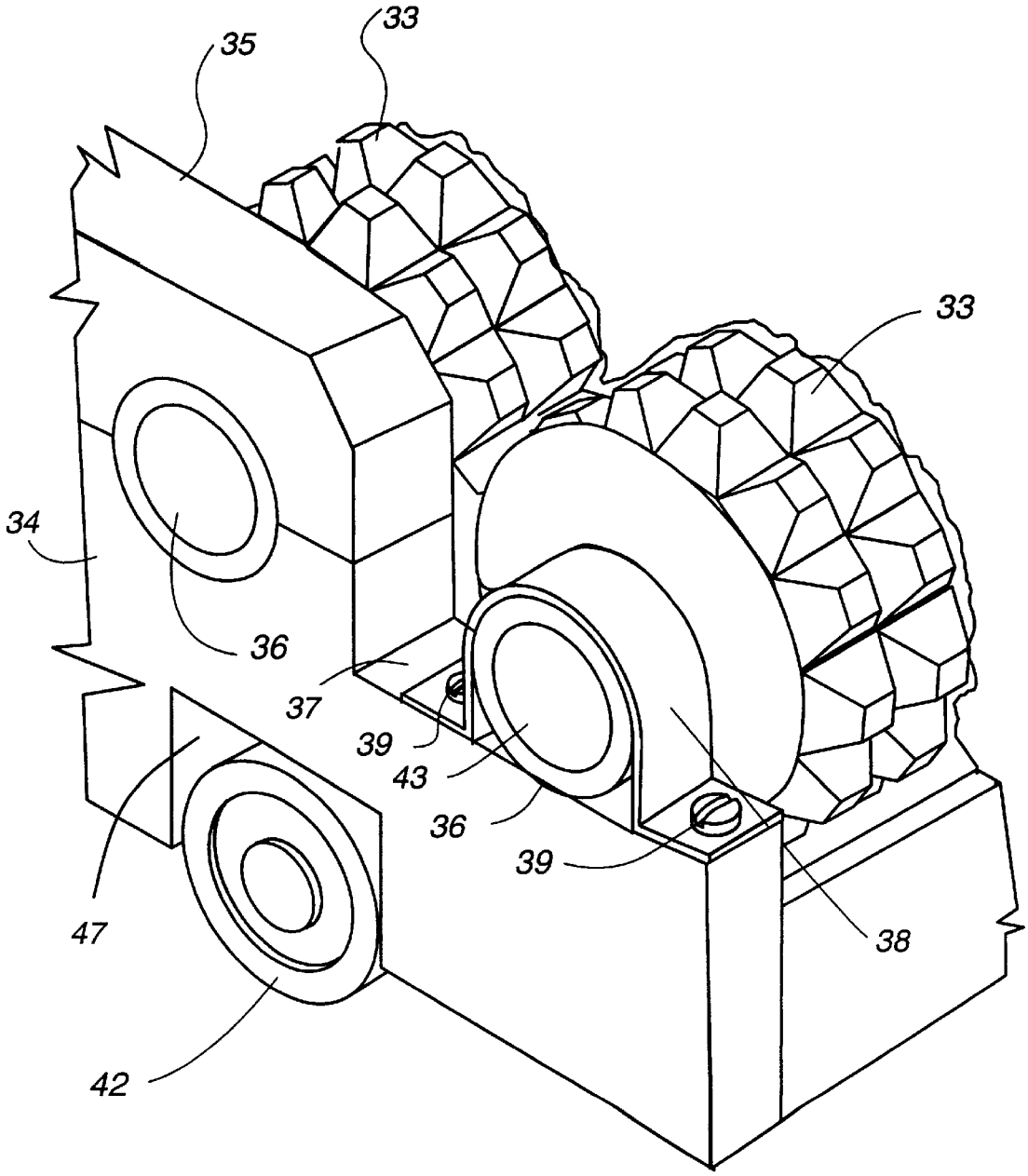
FIG. 11 provides a more detailed view of a portion of an end roller mounting.

In FIG. 11, lower support 34 and locking member 35 surround roller axle assembly 36 and lock it in place. The roller support 34 has cut outs 47 adjacent the ends to provide a seat for each wheel assembly 42 and cut outs 37 for fastening the bearing assemblies 36 to roller support 34 with a metal fixture 38.

In FIGS. 12 and 13, rollers 33 are normally positioned within frames 50 and 51 within cross braces 41 and 41*a*. The massager section 27 of FIG. 12 can include a mechanism which positions it at an angle which is comfortable for the user (not shown).

Figure 14:
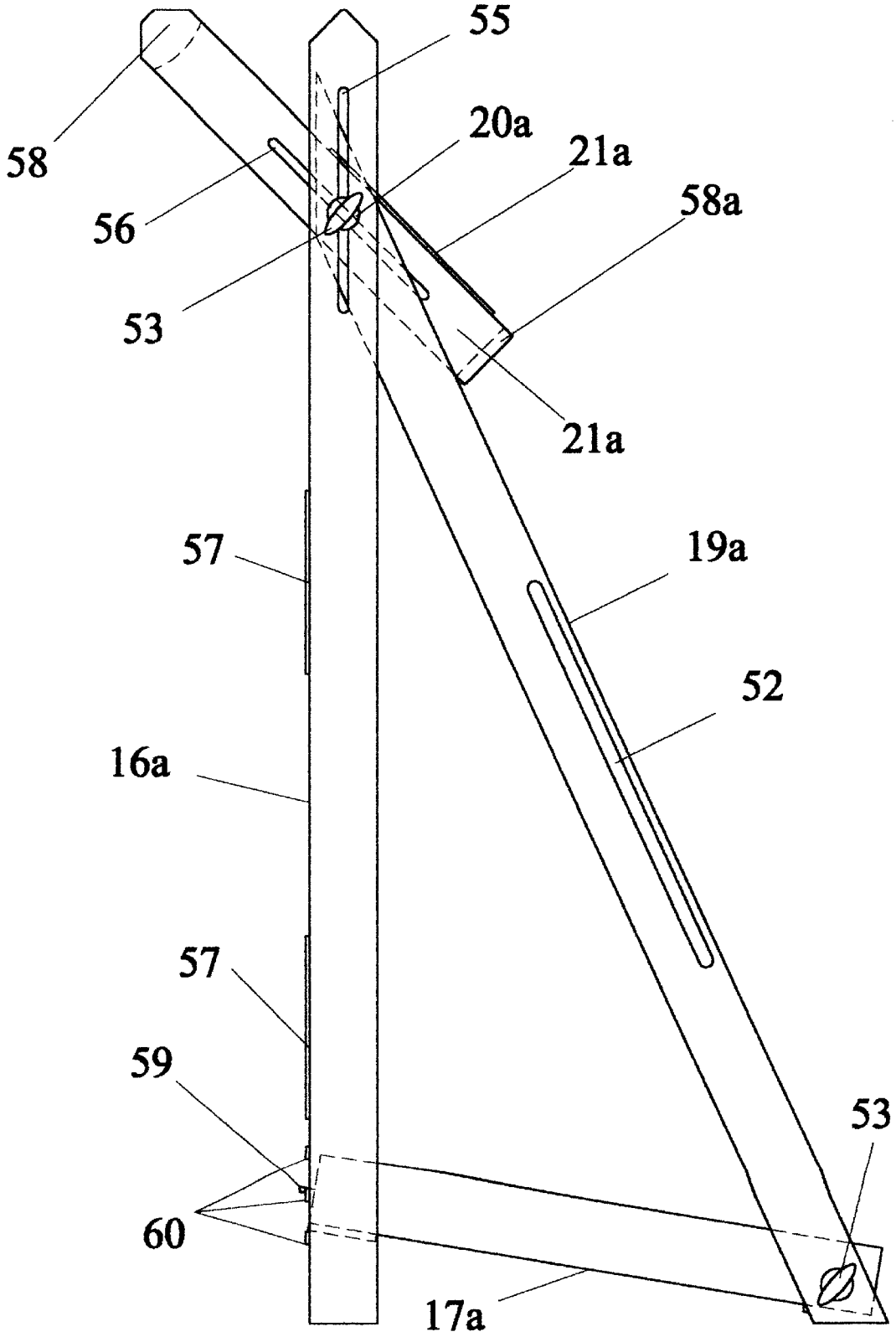
FIG. 14 provides a side view of a collapsible wooden unit in the vertical position.
Figure 15:
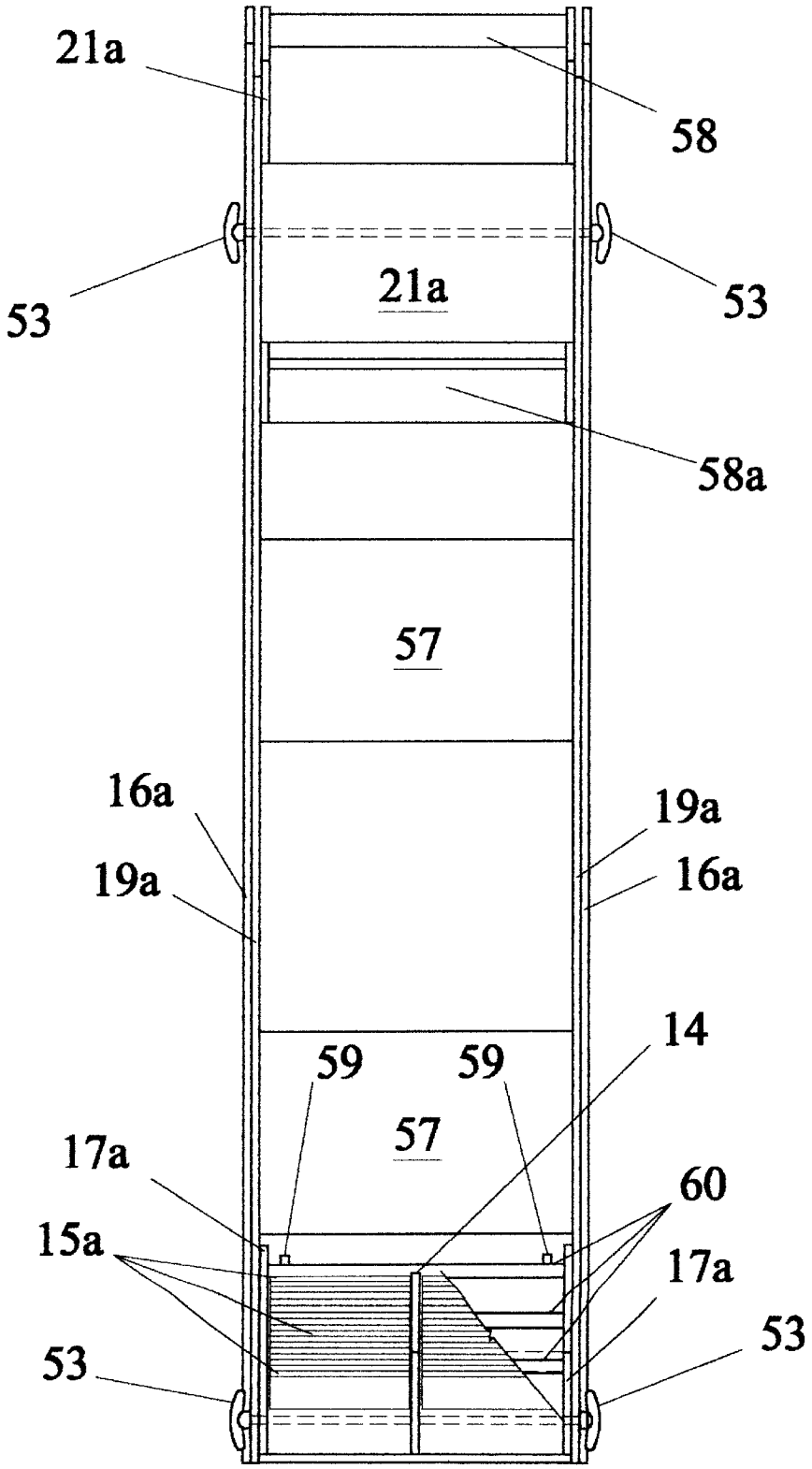
FIG. 15 is a view of the unit of FIG. 14 from the point of view of someone standing away from the unit prior to mounting it for exercise.

In FIGS. 14 and 15, an upright support 16*a* is attached, at its bottom, to treadmill frame 17*a*, and at the top, to safety guard 19*a*. Safety guard 19*a* can have grooves 52 to provide a grip for the user with long strides. In this model, the upright support 16*a* has two braces 57. Arm rest 21*a* can be rotated or raised and lowered by loosening the T-bolts 53, moving the arm rest 21*a* along slots 55 and 56 as desired and retightening the T-bolts 53. Arm rest 21*a* has a cross-brace 57*a* in the form of a pentagonal beam and another padded cross-brace (not shown) within arm rest 21*a*. An end brace 57*b* completes the arm rest 21*a*. A treadmill 15*a* includes a treadmill frame 17*a* with an exerciser section 26 and massager 27.

The unit is collapsed by loosening T-bolts 53 at the top of the upright 16*a* and the lower end of treadmill frame 17*a* thereby allowing the safety guard 19*a* to slide upwardly in slots 55 and 56 after the treadmill frame 17*a* is lifted to release hooks 59 from their position on one of bars 60 and rotated into a parallel relationship with collapsed vertical support 16*a* and safety guard 19*a*.

GENERAL DESCRIPTION OF THE INVENTION

The Figures have been selected to show that a) the exerciser/massager is adaptable for a chic upscale form utilizing the latest metal, plastic and composite materials for the mass market; and b) a simpler wooden configuration for marketing through kits and instructional manuals. In both forms, it is useful to those in homes for the aged, physical therapy clinics, gyms and elsewhere.

The units are designed to meet the strength and support standards established by industry and government for exercise and therapeutic use and, in any event, are to be built to meet the needs of the users for which the safety specifications and warranties apply.

Thus, the safety guards 19 and 19*a* are designed so that the user can hold the safety guards instead of utilizing the arm rest for safety where a longer stride is desired.

The rollers forming the exerciser section of the treadmill and the removable massager section of the treadmill are, in the preferred herringbone design, designed to provide a changing lateral pressure to adjacent parts of the foot bottom due to the rearward thrust of the striding foot against the rollers during use.

While screw and scissors jacks and positioning bars can be used to provide desired arm rest, base and treadmill angles, other devices or mechanisms can be used for the same purposes. The same is true of the means used for positioning various portions of the units during use or storage, e.g., the screw jack handle locks, the dagger locks and the locks designed to removably hold the massager in place.

Now having described my invention, what I claim is:

1. In a treadmill based exerciser having at least one upright means and a treadmill base means with a exerciser treadmill frame means having roller means aligned substantially in parallel and substantially perpendicular to the length of the treadmill, the treadmill base means improvement comprising a combination of a treadmill section means and massager treadmill section means, both of which are used as a single exerciser; and the massager section means is removable for use as a massager means.

2. The treadmill exerciser of claim 1 wherein the treadmill base means includes means for releasing the massager treadmill section means.

3. The treadmill exerciser of claim 1 wherein the at least one upright means and the treadmill frame means can be folded to a substantially parallel position.

4. The treadmill exerciser of claim 1 wherein the design for the roller means have substantially flat topped, substantially pyramid-shaped projections.

5. The treadmill exerciser of claim 4 wherein alternate roller means form a herringbone design.

6. The treadmill exerciser of claim 4 wherein the design for the roller means is formed by at least one spiral groove around the exterior of each roller means combined with a plurality of parallel longitudinal grooves.

7. In a treadmill-based exerciser having at least one upright and a treadmill base means with roller means aligned substantially in parallel and substantially perpendicular to the length of the exerciser, the improvement comprising a treadmill means including roller means having a spiral design of flat topped, substantially pyramid-shaped projections formed by a spiral groove around the exterior of the roller means and substantially parallel grooves along the length of each of the roller means.

8. The treadmill-based exerciser of claim 6 wherein a substantial part of the roller means are in a removable massager treadmill section frame.

9. The treadmill-based exerciser of claim 6 wherein the surface of the rollers is in the form of flat topped pyramids formed by a spiral groove around the roller surface and a plurality of substantially parallel longitudinal grooves.

10. The treadmill-based exercise of claim 8 wherein the rollers are positioned within the exercise treadmill section means and the massager treadmill section means in a herringbone pattern.

11. All inventions taught or described herein.

* * * * *